United States Patent [19]

Hunt, Jr.

[11] 4,214,660

[45] Jul. 29, 1980

[54] CARTON FOR BEVERAGE CANS

[76] Inventor: Letcher B. Hunt, Jr., 2325 W. Avon Rd., Rochester, Mich. 48063

[21] Appl. No.: 21,736

[22] Filed: Mar. 19, 1979

[51] Int. Cl.[2] ..... B65D 5/46

[52] U.S. Cl. ..... 206/427; 229/17 B; 229/52 B

[58] Field of Search ..... 206/427, 491.1, 459, 206/434, 45.31; 229/17 B, 52 B

[56] References Cited

U.S. PATENT DOCUMENTS

| | | | |
|---|---|---|---|
| 3,111,223 | 11/1963 | Jacobi | 206/459 |
| 3,326,369 | 6/1967 | Tolaas et al. | 206/491.1 |
| 3,933,303 | 1/1976 | Kirby, Jr. | 229/17 B |
| 4,030,661 | 6/1977 | Farquhar | 229/17 B |

*Primary Examiner*—William T. Dixson, Jr.

*Attorney, Agent, or Firm*—Reising, Ethington, Barnard, Perry & Brooks

[57] ABSTRACT

A carton for beverage cans is disclosed with a matrix of inspection holes provided in the top and bottom panels to permit viewing of the tops of the cans for the purpose of return refund and the like. The carton has a removable door to provide an access opening and a closure panel is provided so the carton may be used for returning empty beverage cans.

15 Claims, 13 Drawing Figures

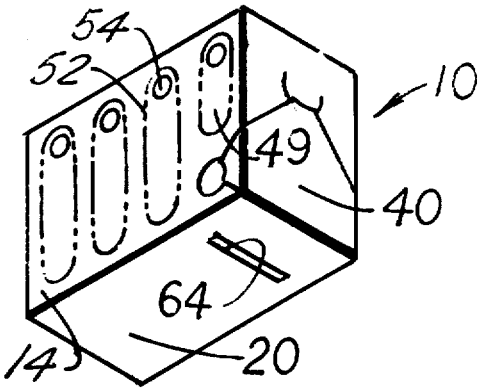
Fig. 3
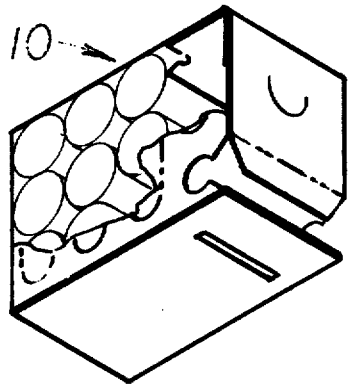
Fig. 4
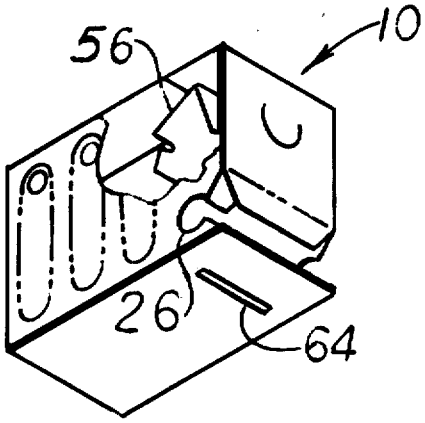
Fig. 5
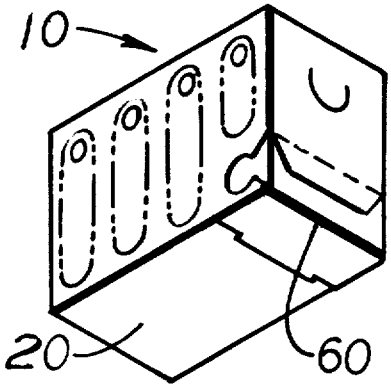
Fig. 6
Fig. 7
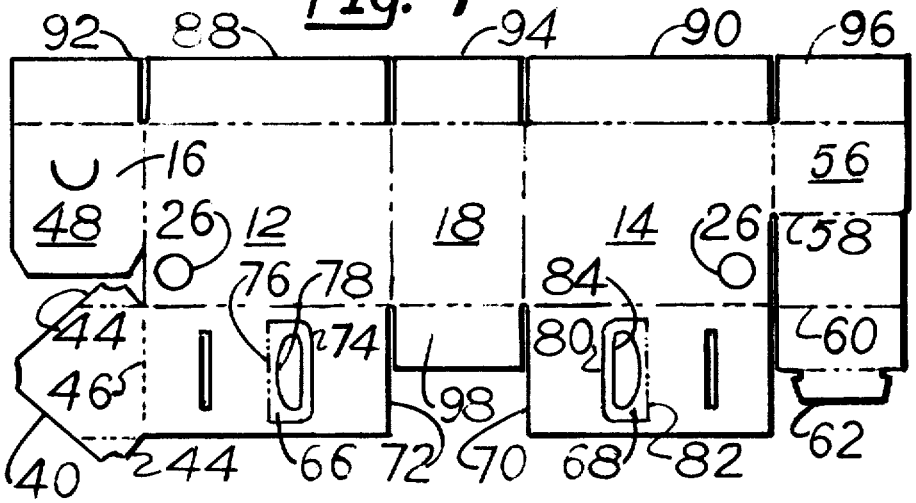

CARTON FOR BEVERAGE CANS

TECHNICAL FIELD

This invention relates to cartons and more particularly to cartons for containing a plurality of cans, such as beverage cans.

BACKGROUND ART

In recent times, certain states have enacted legislation requiring a deposit to be paid at the time of purchase upon certain returnable beverage cans. The deposit is refundable when the empty cans are returned to the retailer. The retailer is also charged a deposit for each can by the distributor and receives a refund for credit upon return of the empty cans. In order to identify refund-bearing cans, the tops of the cans are imprinted with a special notation such as "10¢ Refund Michigan". In order to verify entitlement to a refund for returned cans, it is necessary to visually examine the top of each can for the appropriate refund notation. Canned beverages, such as beer, are usually sold to the consumer in cartons such as the so-called "twelve pack". For convenience of handling, the empty cans are usually returned in the same carton. With the conventional carton, the empty cans must be removed to verify entitlement to refund. This requires repeated handling of the cans and renders the refund process both inconvenient and costly.

In the prior art, cartons for beverage cans have been provided with an access door which opens the carton so that the tops of all of the cans may be viewed through the same door. This same carton is provided with a separate dispenser door which opens at one end so that a can may be removed by allowing it to roll through the dispenser opening. When the carton has been used by the consumer with the access door open and the dispenser door open the carton leaves much to be desired for use in returning the empty cans. If the cans are not oriented properly, the tops cannot be examined without removing them from the carton. Further, cartons with either the access door open or the dispenser door open are not well suited to containment of the cans.

A general object of this invention is to provide a carton for beverage cans which is especially adapted for package sale, such as the so-called six pack or twelve pack, and also for return of the empty cans.

According to this invention, a carton for plural cans is provided with a matrix of inspection holes in the top panel and, preferably, also in the bottom panel; the matrix arrangement is such that a hole boundary extends across each can position in the perimeter of each position to expose a portion of the top of each can to view and to retain each can in position. Additionally, one of the other panels defines a tear line circumscribing a first portion of the panel to provide a door which is adapted to be removed to provide an access or dispenser opening in the carton.

Additionally, according to the invention, the carton is provided with a foldable panel disposed inside and adjacent the panel providing the dispenser opening. The foldable panel is adapted to be folded away from the opening to allow all cans to be dispensed through the opening and it is adapted to be extended across the opening to retain cans in the carton when it is used to return empty cans.

Further, according to the invention, a foldout handle is provided on one of the panels of the carton.

Further, according to the invention, the inspection holes are provided in such a manner that the structural strength of the carton is maintained even after the dispenser door has been opened so that the carton remains strong for use in carrying the empty cans.

The carton of this invention greatly facilitates the return of empty cans for refund. It permits visual inspection of the top of each can in the carton without removal or manipulation of the cans. Also, it lends itself to display of advertising matter on the carton itself and also on the ends of the cans while the cans are in the carton.

A more complete understanding of this invention may be obtained from the detailed description that follows taken with the accompanying drawings.

BRIEF DESCRIPTION OF DRAWINGS

FIGS. 3, 4, 5, and 6 show the same carton in different conditions;

FIG. 7 shows a blank from which a carton is formed,

BEST MODE FOR CARRYING OUT THE INVENTION

Figure 1:
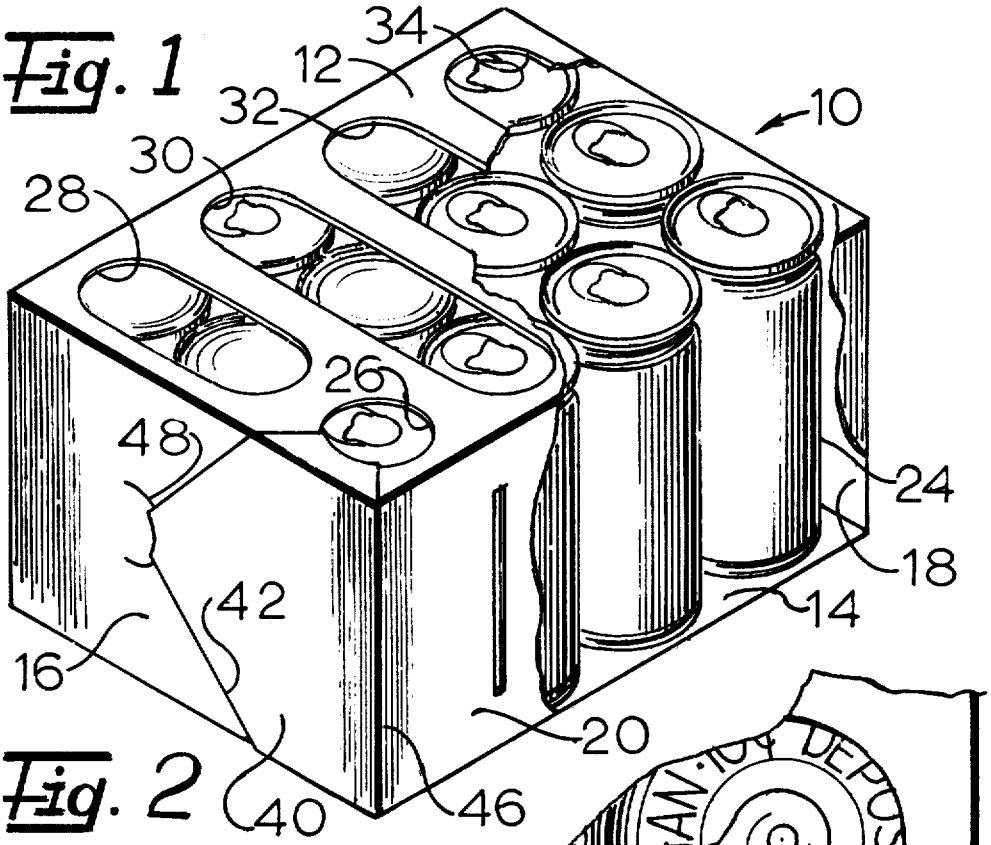
FIG. 1 is a pictorial view of the carton of this invention.

Referring now to the drawings, there is shown an illustrative embodiment of the invention in a carton for round beverage cans. In particular, the drawings show a carton for beer cans in a so-called twelve pack. It will be apparent as the description proceeds that the inventive carton is useful for packaging cans in various numbers and for various goods.

Referring now to FIG. 1, the carton 10 comprises a rectangular box having a top panel 12, a bottom panel 14, an end panel 16, and an end panel 18. The carton also has a front panel 20 and a back panel 22 which is hidden in FIG. 1 but shown in FIG. 4. The carton 10 is adapted to contain twelve beer cans 24 of standard size. The cans 24 are arranged in the carton in a matrix or array made up of four columns with three cans in each column and three rows with four cans in each row. In general, the carton has a width, measured between the front panel 20 and the back panel 22, which is approximately "n" can diameters, where "n" is any integer. In the example, "n" is equal to three. The carton has a length, measured between the end walls 16 and 18, which is approximately "m" can diameters where "m" is any integer. In the example, "m" is equal to four. Thus, the carton provides a number of can positions equal to "n" times "m" and is adapted to receive a can in each position with the can bottom and top adjacent the bottom and top panels respectively.

Figure 2:
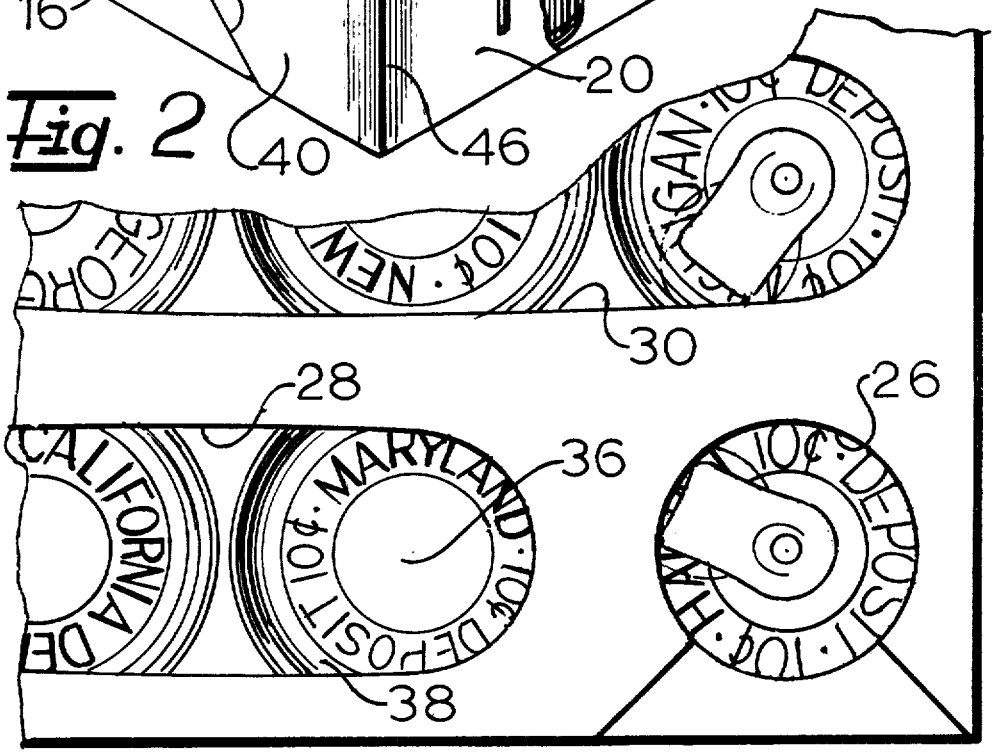
FIG. 2 is a fragmentary view of the carton showing certain details.

As shown in FIG. 1, the top panel 12 defines a matrix of inspection holes including a one-can hole 26, a two-can hole 28 and a set of three three-can holes 30. As shown in FIG. 2, the inspection holes permit the viewing of the tops of the cans 24 so that the refund notation such as "10¢ Deposit Maryland" is clearly visible. The inspection holes also lend themselves to viewing of advertising matter imprinted on the tops of the cans in selected locations such as a circular space 36 and an annular space 38. It is noted that the hole boundary of each hole extends across each can position within the perimeter of each position. In particular, the one-can hole 26 is circular and has a diameter which is smaller than the diameter of the can position. Hence, the hole boundary extends across the can position within the perimeter of the can position and accordingly, the panel portion defining the opening 26 retains the can in position. The two-can inspection hole 28 is oblong and the longest dimension of the hole boundary is less than two can diameters and the narrow dimension of the hole boundary is less than one can diameter. The three-can holes 30 are identical to each other and are oblong with the long dimension being less than three can diameters and the narrow dimension being less than one can diameter. Accordingly, the hole boundaries for the two-can hole and the three-can holes extend across the respective can positions within the perimeter thereof and the panel, defining the holes, is effective to retain the cans in position.

The carton 10 of FIG. 1 is suitably made by folding a single-piece cardboard blank which is shown in FIG. 7.

The carton 10 is provided with a dispenser door 40 as shown in FIG. 1. The dispensor door 40 is provided on the end panel 16 by means of a tear line 42. The tear line 42 may take the form of a perforated line; however, this embodiment of the tear line 42 is provided by the overlap of the door 40, as one panel portion, with the other panel portion of the panel 16. The door 40, as shown in FIGS. 1 and 7 includes a pair of tabs 44 which overlay respectively the top and bottom panels 12 and 14. The door 40 is releasably secured to the remaining portion of panel 16 by an adhesive material and the tabs 44 are secured to respective top and bottom panels in the same manner. As shown in FIG. 7, the door 40 is provided with a perforated tear line 46. The panel 16 is provided with an arcuate slit 48 which defines a finger hole to aid in tearing the door 40 open. Also the inspection holes 26 serve as a finger hole for tearing the door 40 open.

FIG. 3 shows an embodiment of the carton 10 which is the same as that of FIG. 1 except that removable hole covers 50 are provided on each of the two-can holes and three-can holes. The hole covers 50 are provided in the bottom panel 14 by perforated tear lines 52 in the panel which define the boundaries of the covers. A finger hole 54 is provided in each cover to facilitate tearing of the cover along the tear line. The covers 50 are suitably provided in the top panel 12 in the same manner.

FIG. 4 shows the carton 10 with the dispenser door 40 removed and with the carton partially emptied of cans. The cartons includes a foldable panel 56 which is in the position shown in FIG. 4 when the carton 10 is packed full of cans. The foldable panel 56, as shown in FIG. 7, is provided with fold lines 58 and 60 which allow it to assume the configuration shown in FIG. 4.

When the carton is empty and it is to be used for returning empty cans, the foldable panel 56 serves as a closure for the dispenser opening. As shown in FIG. 5 the foldable panel 56 is in an intermediate stage of unfolding. It may be pulled from its folded position of FIG. 4 through the dispenser opening and folded at the fold line 60 to lie flat against the front panel 20. The panel 56 is provided with an end tab 62 which is inserted into a slot 64 in the front panel to retain the foldable panel 56 in the position shown in FIG. 6.

Figure 10:
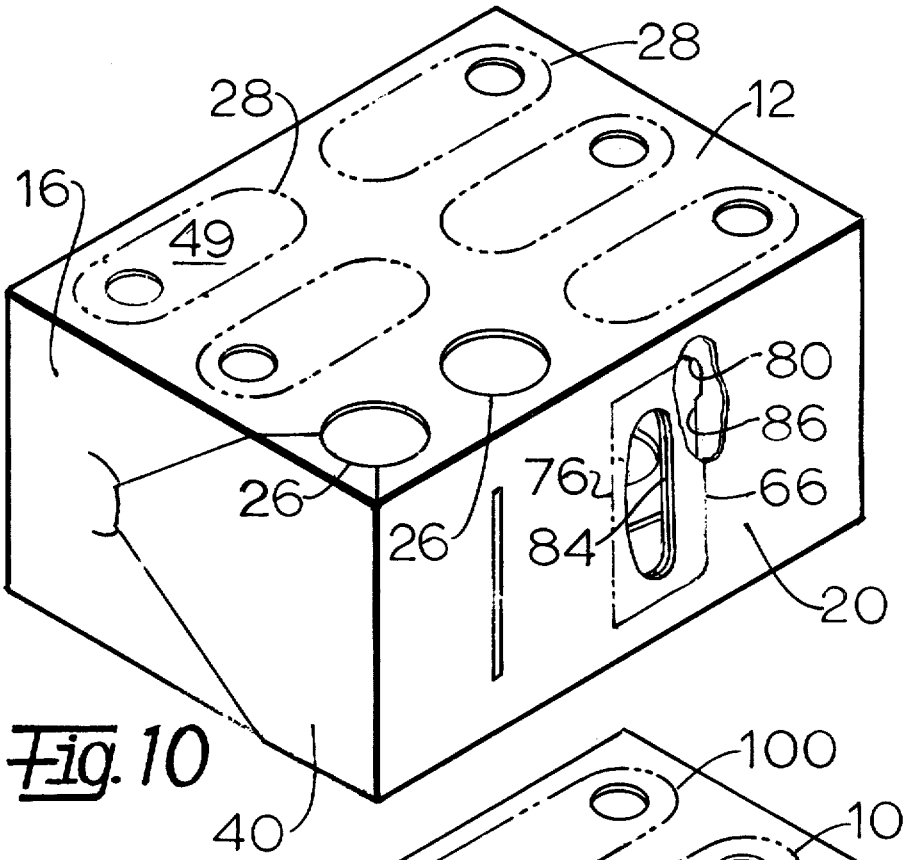
FIG. 10 shows a third modification.

As shown in FIGS. 7 and 10, the carton is provided with a carrying handle comprising handle members 66 and 68 in the front panel 20. As shown in FIG. 7 the front panel comprises an inner sheet 70 and an outer sheet 72 which contain the handle members 68 and 66 respectively. The handle member 66 is provided in the outer sheet by a slit or a perforated tear line 74 and a fold line 76. It is also provided with a finger hole 78. Similarly the handle member 68 is provided in the sheet 70 by a slit or a perforated tear line 80 and a fold line 82 and it is provided with a finger hole 84. As shown in FIG. 10, the inner sheet 70 and the outer sheet 72 are overlayed to form the front panel 20. The finger holes 84 and 78, for the most part, are in registry with each other; it is preferred to have the finger hole 78 offset slightly toward the fold line 76 from the finger hole 84 so that the two will be more nearly in registry when the handle members are folded outwardly for use in carrying the carton. The tear line 80 in the inner sheet 70 has a configuration to provide a small lip 86 which protrudes beyond the edge of tear line 66. This lip 86 serves as a retainer means for the handle members after the handle members have been pulled out for use and then pushed back through the plane of the inner sheet 70.

The back panel 22 which is shown in the view of FIG. 4 is comprised of a pair of half-panels or sheets 88 and 90, as shown in FIG. 7. In a conventional manner, the carton blank, as shown in FIG. 7, is provided with construction flaps 92, 94, 96, and 98 integral with the adjoining panels 16, 18, 56, and 18 respectively. These construction flaps are connected with the respective panels by fold lines and when the carton blank is folded into the box configuration the flaps may be secured to adjacent panels by a suitable adhesive.

Figure 8:
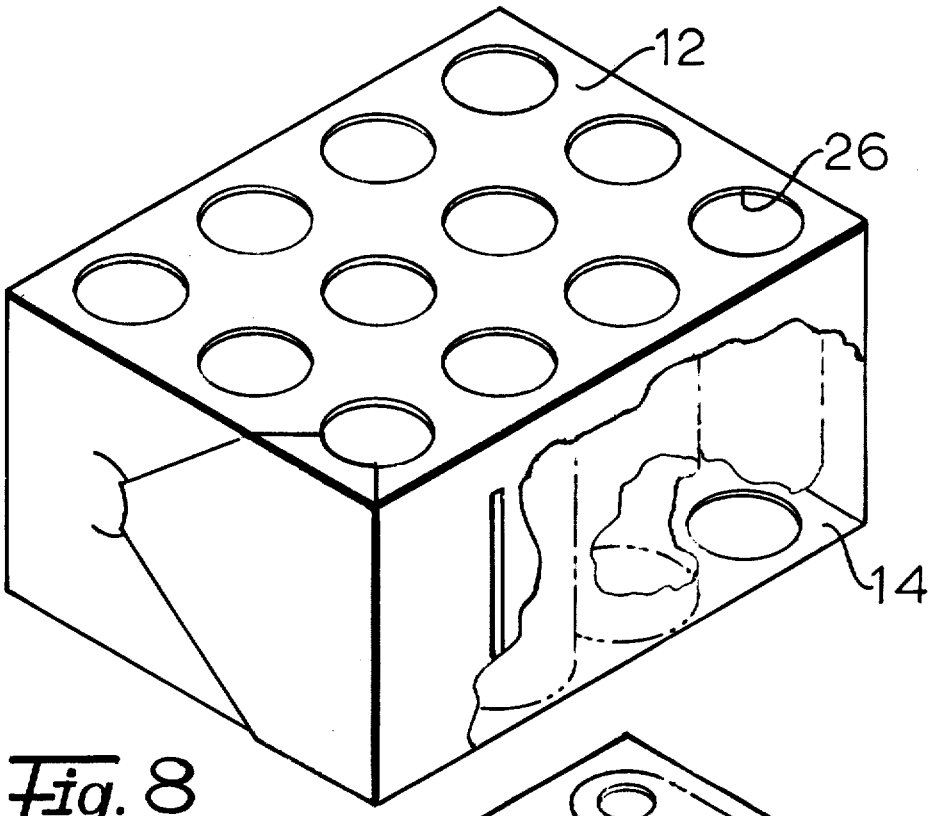
FIG. 8 shows a first modification of the inventive carton.

FIG. 8 shows a first modification of the carton. In this modification the top panel 12 and the bottom panel 14 are provided with identical matrices of inspection holes 26. Each of the inspection holes 26, as described with reference to FIG. 1, is a one-can hole and is circular.

Figure 9:
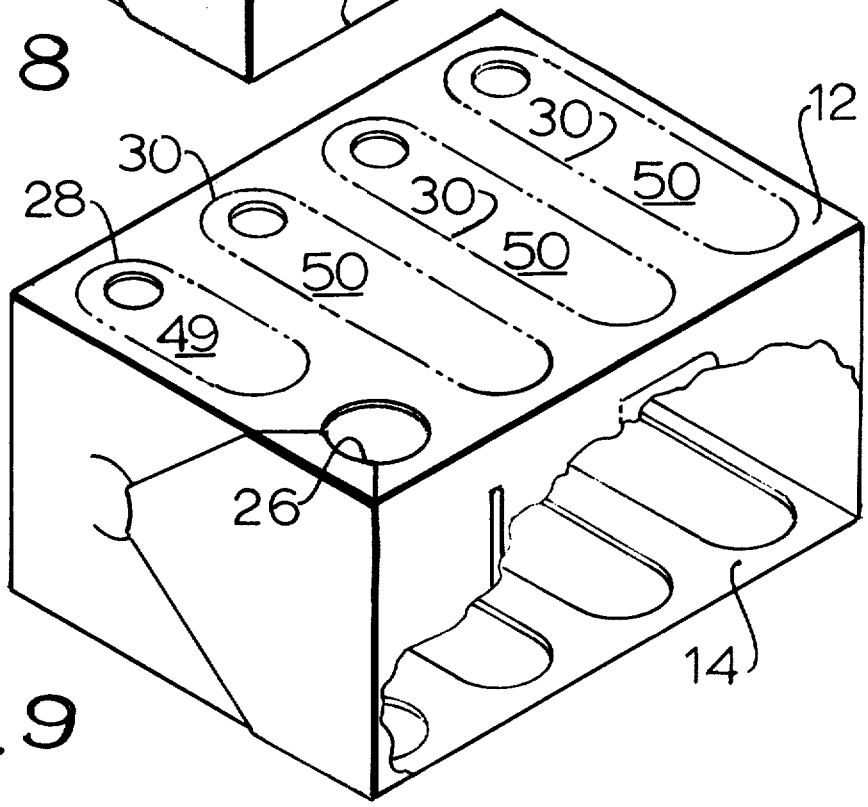
FIG. 9 shows a second modification.

FIG. 9 shows a second modification of the carton. This modification includes the same matrix of inspection holes in the top panel 12 as in the bottom panel 14. This includes a one-can inspection hole 26, two-can inspection hole 28, and three three-can inspection holes 30. The inspection holes in top panel 12 are provided with hole covers 49 and 50. The bottom panel 14 is not provided with hole covers.

FIG. 10 shows a third modification. In this modification the top panel is provided with two one-can inspection holes 26 and with five two-can inspection holes 28. The inspection holes are provided with hole covers 49. The bottom panel, not shown, may be provided with the same or a different matrix of inspection holes.

Figure 11:
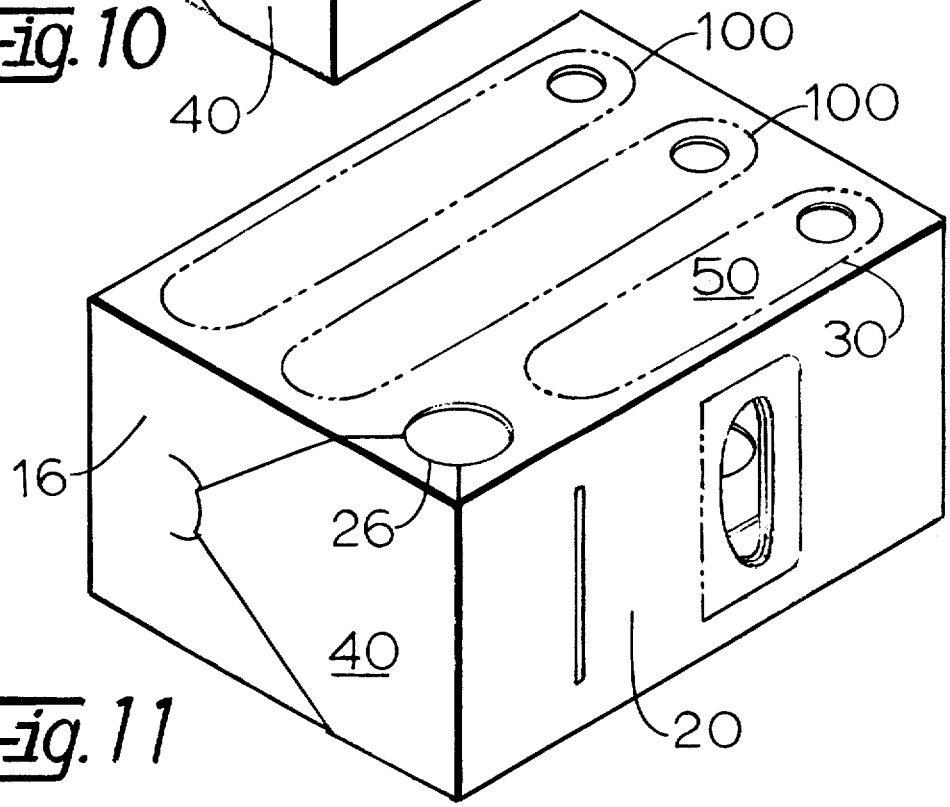
FIG. 11 shows a fourth modification.

FIG. 11 shows a fourth modification in which the top panel is provided with a single one-can inspection hole 26, a single three-can inspection hole 30 and a pair of four-can inspection holes 100.

Figure 12:
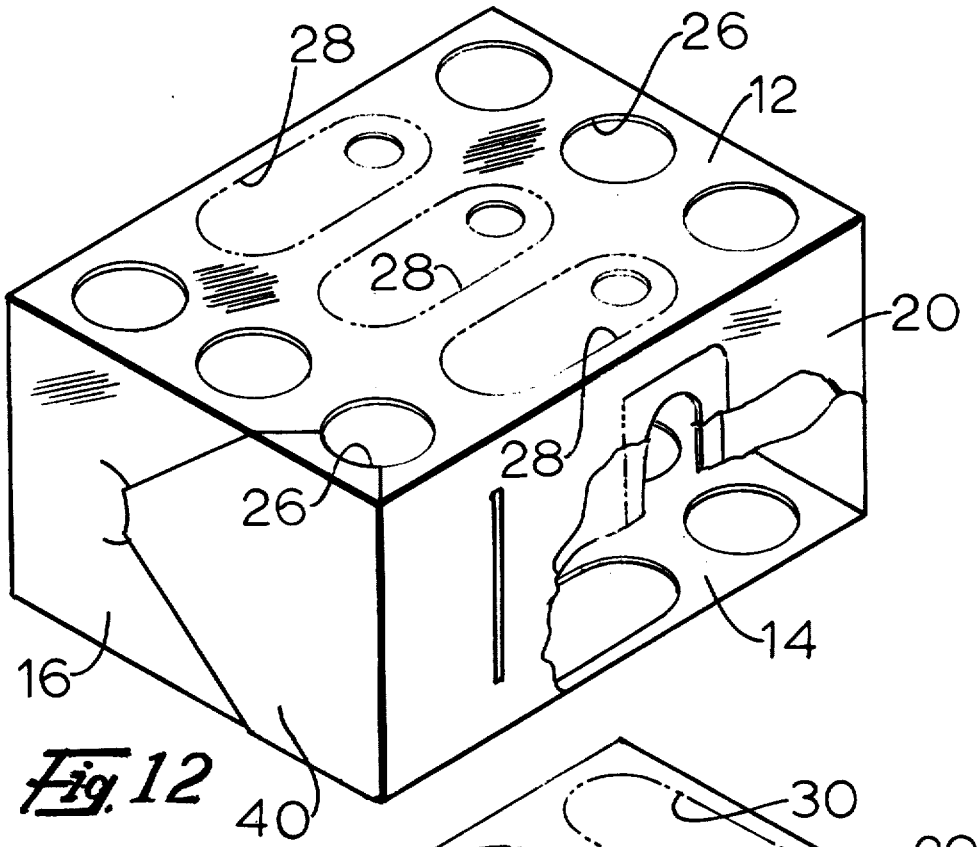
FIG. 12 shows a fifth modification.

FIG. 12 shows a fifth modification in which the top panel is provided with six one-can inspection holes 26 and three two-can inspection holes 28. The bottom panel is provided with the same matrix of inspection holes.

Figure 13:
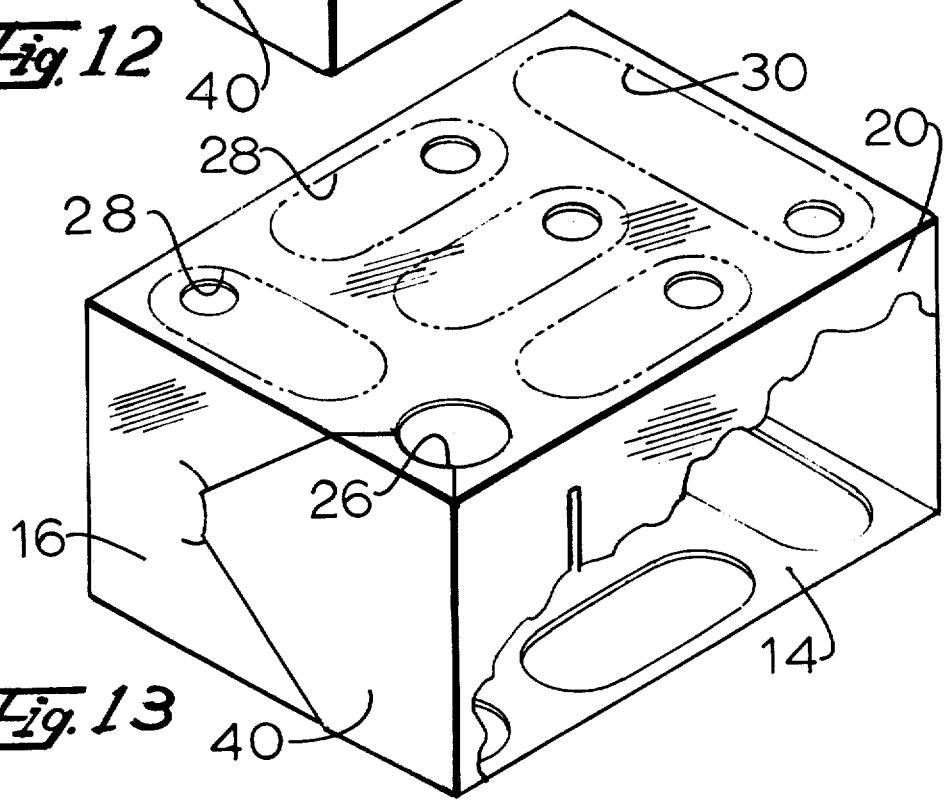
FIG. 13 shows a sixth modification.

FIG. 13 shows a sixth modification in which the top panel is provided with a single one-can inspection hole 26, four two-can inspection holes 28 and a single three-can inspection hole 30. The bottom panel is suitably provided with the same matrix of inspection holes.

Although the description of this invention has been given with reference to a particular embodiment it is not to be construed in a limiting sense. Many variations and modifications will now occur to those skilled in the art. For definition of the invention reference is made to the appended claims.

What is claimed is:

1. A carton for round cans all having the same diameter, said carton comprising: a rectangular box having front and back panels, two end panels, a bottom panel, said front and back panels being spaced apart by approximately "n" can diameters, said end panels being spaced apart by approximately "m" can diameters, said cartons providing "n" times "m" can positions and being adapted to receive a can in each position with the can bottom and top adjacent the bottom and top panels, respectively, one of said bottom and top panels defining a matrix of inspection holes in an arrangement such that a hole boundary extends across each can position within the perimeter of each position thereby exposing a portion of each can to view and retaining each can in position, one of the other panels defining a tear line circumscribing a first portion of said other panel whereby said first portion is adapted to be removed from a second portion of said other panel to provide an access opening in said box for removing the cans from the carton and returning the cans to the interior of the carton, and an additional panel connected with one of the other panels and adapted to extend across said access opening to retain the cans which are returned to the interior of the carton.

2. The invention as defined in claim 1 wherein said one of the other panels is an end panel and said tear line extends across said end panel between the top panel and the bottom panel and also extends from a point adjacent the edge of the top panel to one of the front and back panels and from a point adjacent the edge of the bottom panel to said one of the front and back panels, said panel portion being large enough for a can to roll through the access opening provided thereby.

3. The invention as defined in claim 2 wherein said additional panel is a foldable panel disposed inside said box adjacent said end panel and being supported adjacent said second portion of said panel, said foldable panel having an unfolded length greater than the length of said end panel, the foldable panel being adapted to be folded away from said first portion of said panel so as to avoid obstruction of said access opening when the first portion of said panel is removed whereby cans may be removed from said box and being adapted to be unfolded when the box is empty to extend across said access opening to retain cans in the box.

4. The invention as defined in claims 1 or 2 wherein both of said bottom and top panels define said matrix.

5. The invention as defined in claim 1 or 2 wherein some of said inspection holes are filled by respective hole covers, each respective cover being attached by a tear line to the respective panel.

6. The invention as defined in claim 3 including retaining means adapted to receive the end of said foldable panel.

7. The invention as defined in claim 1 wherein one of said front or back panels has an outer sheet and an inner sheet, each of said sheets defining a perforate tear line circumscribing a handle member, the tear line in the outer sheet overlying at least part of the tear line in the inner sheet whereby the handle portions can be folded out of the plane of the panel.

8. The invention as defined in claim 7 wherein at least part of the outer tear line is outside the perimeter of the inner tear line.

9. The invention as defined in claim 1 wherein said one of the other panels is an end panel.

10. The invention as defined in claims 1 or 2 wherein said matrix includes one inspection hole which does not extend over more than one can position.

11. The invention as defined in claims 1 or 2 wherein all of said inspection holes are circular and each hole does not extend over more than one can position.

12. The invention as defined in claims 1 or 2 wherein said matrix includes plural inspection holes, some of said holes extending over a column of "n" can positions, said column being parallel to said end panels.

13. The invention as defined in claims 1 or 2 wherein said matrix includes plural inspection holes, some of said holes extending over a row of one half "m" can positions, said rows extending perpendicular to said end panels.

14. The invention as defined in claims 1 or 2 wherein said matrix includes plural inspection holes, some of said inspection holes extending over a row of "m" can positions, said row being perpendicular to said end panels.

15. The invention as defined in claims 1 or 2 wherein said matrix includes plural inspection holes, some of said holes extending over a row of one half "m" can positions, said row being perpendicular to said end panels, and at least one hole extending over a column of "n" can positions, said column being parallel to said end panels.

* * * * *